US008312687B2

(12) United States Patent
Yee

(10) Patent No.: US 8,312,687 B2
(45) Date of Patent: Nov. 20, 2012

(54) SUPPORT MEMBER FOR PLACING REINFORCING BARS

(76) Inventor: Michael Dean Yee, Rockyview (CA)

( * ) Notice: Subject to any disclaimer, the term of this patent is extended or adjusted under 35 U.S.C. 154(b) by 0 days.

(21) Appl. No.: 12/795,487

(22) Filed: Jun. 7, 2010

(65) Prior Publication Data

US 2010/0307098 A1 Dec. 9, 2010

Related U.S. Application Data

(60) Provisional application No. 61/184,450, filed on Jun. 5, 2009.

(51) Int. Cl.
*E04C 5/16* (2006.01)

(52) U.S. Cl. ..... 52/687; 52/649.8; 52/678; 404/136; D8/354

(58) Field of Classification Search ..... 52/25, 582.2, 52/633, 649.7, 649.8, 677, 678, 680, 687, 52/688; 404/134–136; D8/354
See application file for complete search history.

(56) References Cited

U.S. PATENT DOCUMENTS

| | | | | |
|---|---|---|---|---|
| 4,655,023 | A * | 4/1987 | Yung | 52/685 |
| 4,899,963 | A * | 2/1990 | Murphy | 248/65 |
| 4,942,714 | A * | 7/1990 | Langley et al. | 52/687 |
| 5,555,693 | A * | 9/1996 | Sorkin | 52/689 |
| 5,664,390 | A | 9/1997 | Sorkin | |
| 5,791,816 | A * | 8/1998 | McCallion | 404/136 |
| 6,092,960 | A * | 7/2000 | McCallion | 404/70 |
| D483,246 | S | 12/2003 | McPherson et al. | |
| 7,108,453 | B2 * | 9/2006 | Harris | 404/135 |
| D548,054 | S * | 8/2007 | Erickson et al. | D8/354 |
| 7,775,010 | B2 * | 8/2010 | Lee et al. | 52/677 |
| 2003/0009979 | A1 * | 1/2003 | Haslem et al. | 52/677 |
| 2004/0031228 | A1 * | 2/2004 | Hardy et al. | 52/687 |
| 2007/0209310 | A1 | 9/2007 | Papke | |
| 2008/0028718 | A1 * | 2/2008 | Erickson et al. | 52/687 |

* cited by examiner

*Primary Examiner* — William Gilbert
(74) *Attorney, Agent, or Firm* — Kent Daniels; Blake, Cassels & Graydon LLP

(57) ABSTRACT

A support frame system for placing and securing reinforcing bars, which includes an elongated beam member which includes a plurality of saddles at a predetermined spacing. Support legs extending from the beam member hold the beam member, and thus also the re-bars, at a fixed distance above the mold. Once re-bars have been laid in the desired saddles, mating clips can be placed around each re-bar and locked onto the beam member to prevent movement of the re-bars during a subsequent concrete pour. Two or more of these beam members can be connected together end-to-end using mating prongs and holes at opposite ends of each beam member.

11 Claims, 5 Drawing Sheets

SUPPORT MEMBER FOR PLACING REINFORCING BARS

CROSS-REFERENCE TO RELATED APPLICATIONS

This application claims benefit of provisional U.S. Patent Application Ser. No. 61/184,450 filed on Jun. 5, 2009, the entire contents of which are hereby incorporated herein by reference.

FIELD OF THE INVENTION

The present application relates generally to concrete reinforcement systems, and, more specifically, to a support member for placing reinforcing bars.

BACKGROUND

It is common practice to install steel reinforcing bars (re-bar) to strengthen concrete structures. Typically, a project design engineer will specify the size, number and type of re-bar to be used, and determine the precise locations within the structure that each re-bar is to be located. On the job-site, the tradesmen must measure and place the re-bar within a concrete form such that, after the concrete is poured into the form and cured, the re-bars will be properly located within the finished concrete structure in accordance with the engineer's specifications.

The correct placement of re-bar within the form requires precise measurement and careful placement of re-bars within the form. Re-bars are typically tied together using steel wires to keep them in place. However even with these precautions, re-bars can be dislodged both before and during the poring of the concrete. Various means have been proposed to securely support re-bars at the desired locations within a concrete form, and to prevent unintentional movement of the re-bar during the concrete pour.

U.S. Patent Application Publication No. 2007/0209310 (Papke) discloses a device for supporting multiple re-bars at a predefined spacing. The device described by Papke comprises a concrete beam member having recesses or saddles at predefined locations for holding re-bars. Each saddle is associated with a pair of wires embedded in the beam member for securing a re-bar in place. The very high weight of concrete increases costs to manufacture and use Papke's beam member. In addition, it is not possible to place multiple beam members end-to-end while maintaining an accurate spacing between recesses of adjacent beam members. Nor is it practical to secure Papke's concrete beam members in a vertical mould such as for a wall.

U.S. Design Pat. No. D483246 (McPherson et al.) discloses a re-bar support which comprises an elongated beam member having integrally formed clips for holding re-bars at a fixed spacing determined by the locations of the clips. The use of integrally formed clips severely limits the range of different sizes of re-bars that can be securely held.

U.S. Pat. No. 5,664,390 (Sorkin) discloses an elongated support beam member which includes a plurality of saddles for maintaining re-bars at a predetermined spacing. Two or more of these beam members can be connected together end-to-end using a mating prong and cup at opposite ends of the beam member. Once re-bars have been laid in the desired saddles, each re-bar can be tied in place using wire to prevent movement of the re-bars during a subsequent concrete pour. Wire ties are time-consuming to install properly, and thus increase labor costs.

Techniques that overcome limitations in the above-noted prior art remain highly desirable.

SUMMARY

An aspect of the present invention provides a support frame system for placing and securing reinforcing bars, which includes an elongated beam member which includes a plurality of saddles at a predetermined spacing. Support legs extending from the beam member hold the beam member, and thus also the re-bars, at a fixed distance above the mold. Once re-bars have been laid in the desired saddles, mating clips can be placed around each re-bar and locked onto the beam member to prevent movement of the re-bars during a subsequent concrete pour. Two or more of these beam members can be connected together end-to-end using mating prongs and holes at opposite ends of each beam member.

In use, a plurality of support frames can be connected together and placed within a mold. Accurate placement of the support frames within the mold ensures that re-bars can then be quickly and accurately located in accordance with the project engineer's specifications, simply by placing the re-bars in the appropriate saddles. The shape of the saddles ensures that a variety of re-bar sizes can be accommodated by the support frame without loss of positioning accuracy. Similarly, the shape of the mating clips ensures that that re-bars of a wide range of different sizes can be securely held within each saddle.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

The present invention provides a support frame system for placing and securing reinforcing bars A representative embodiment is described below with reference to FIGS. 1-5*b*.

Figure 1:
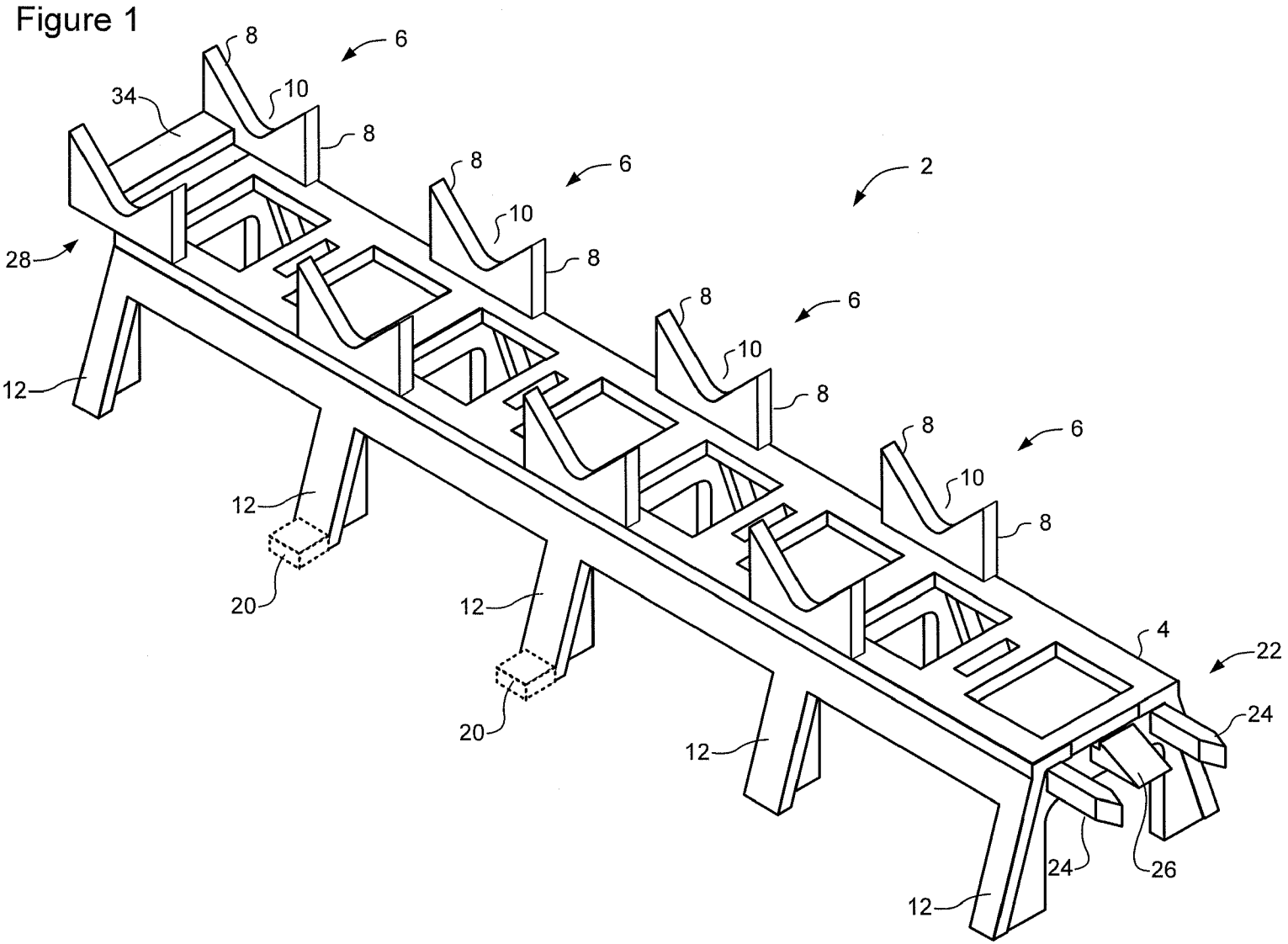
FIG. 1 is a perspective view showing a support frame in accordance with a representative embodiment of the present invention.
Figure 2:
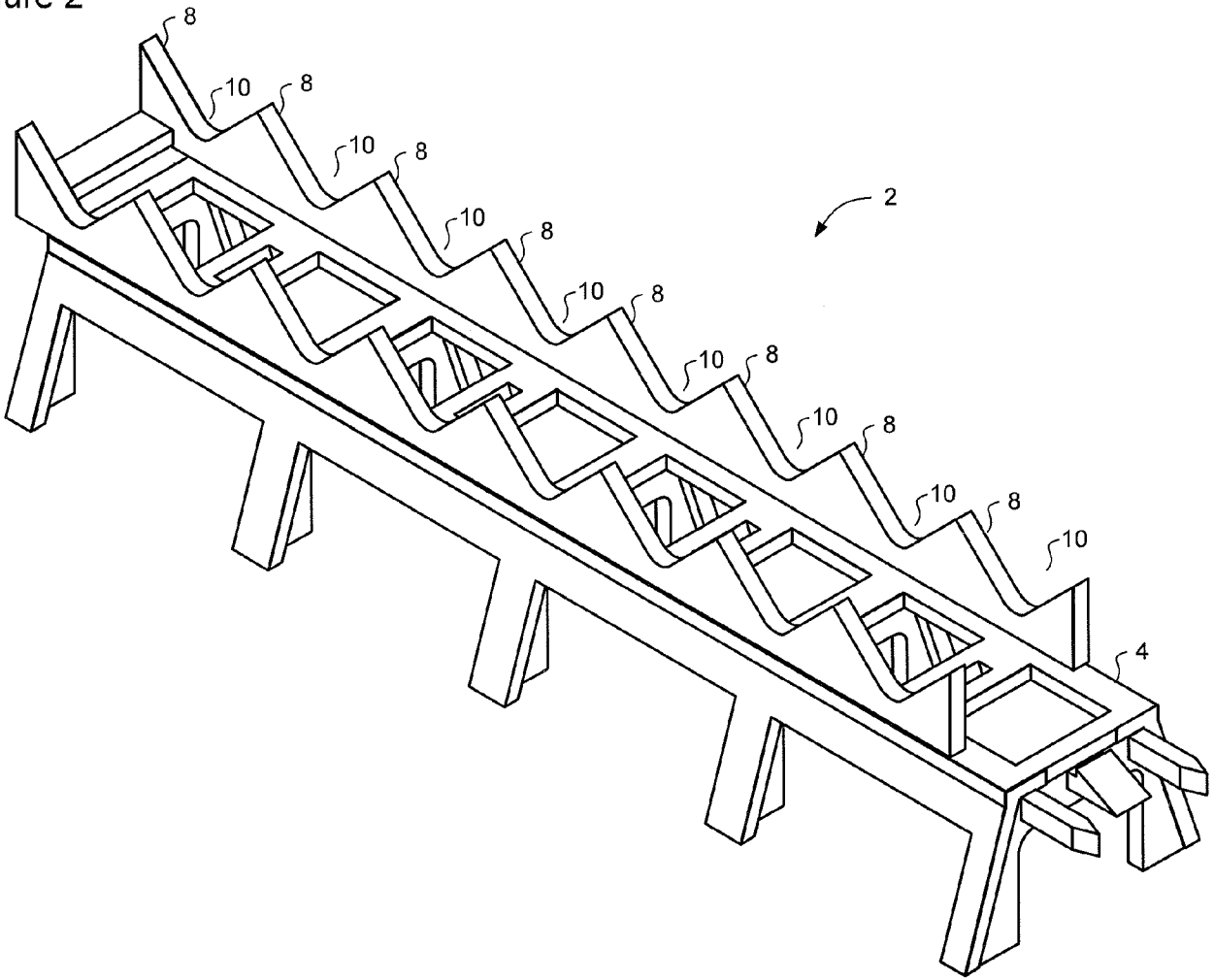
FIG. 2 is a is a perspective view showing a support frame in accordance with a second representative embodiment of the present invention.

Referring to FIG. 1, a support frame 2 in accordance with the present invention generally includes an elongated beam member 4 which includes a plurality of saddles 6 at a predetermined spacing along the beam member 4. Each saddle 6 is provided by a pair of prongs 8 which define a generally V-shaped notch 10. A re-bar placed within the saddle will therefore be seated against the opposed walls of the V-shaped notch 10, which will hold the re-bar accurately centered within the saddle 6. Consequently, re-bars placed within desired ones of the saddles 6 will be accurately held a fixed spacing determined by the design of the support frame 2.

The support frame 2 may be made of any suitable material including, but not limited to metals and plastics. In cases where plastic is used, a reinforcing fibre, such a glass fiber, may be also be used to improve rigidity and strength. This is advantageous, in that it enables the support frame 2 to be designed with comparatively large openings which allow fluid concrete to flow into and around the support frame 2 during a concrete pour, and thereby minimize the formation of voids due to the presence of the support frame 2.

Preferably, the predetermined spacing between saddles 6 is selected to match spacing increments most commonly utilized by design engineers in determining the locations of re-bars within a concrete structure such as a floor or wall. For example, saddles 6 can be spaced 1 or 2 inches apart, allowing the spacing between re-bars to be accurately fixed at equivalent increments.

Preferably, the prongs 8 of each saddle 6 are sized to provide secure support for re-bars within the range of sizes typically specified by design engineers. For example, in some embodiments, the prongs 8 are sized such that the V-shaped notch 10 will accommodate re-bars of between ¼-inch and about 1-inch in diameter, although this is not essential.

Preferably, the height of the prongs 8, and the opening angle of the V-shaped notch 10 are selected to enable a worker to rapidly place re-bars into desired saddles 6, and to prevent the so-placed re-bars from rolling out of the desired saddles before clips or other fasteners can be applied to secure each re-bar into position on the frame member 2. In the illustrated embodiment, the prongs 8 are sized an shaped such that the opening angle of the V-shaped notches is about 90-degrees. However, it will be appreciated that this is not essential.

As may be seen in FIG. 1, legs 12 extending from the beam member 4 are arranged at desired intervals so as to support the saddles 6 at a predetermined distance from a support surface (not shown). Preferably, the size of each leg 12, and the spacing between adjacent legs is selected to ensure that the support frame 2 is not by either the re-bar placed upon it or the loads transferred to the support frame 2 by the wet concrete during the pour. In the embodiment of FIG. 1, the spacing between legs corresponds to the spacing between saddles 6, but this is not essential. If desired, different sets of support frames 2 can be constructed, each having a respective different leg heights. With this arrangement, support frames 2 may be selected for use in accordance with the desired positioning of re-bars within the finished concrete slab. For example, support frames 2 may be selected such that the re-bars are approximately centered within the finished concrete slab.

If desired, at least some of legs may be provided with a foot or tab 20 at the base thereof. Such tabs 20 can be used to facilitate nailing the support frame 2 to the interior of a mold (not shown) to prevent undesired movement of the frame prior to or during placement of the re-bars. This arrangement can be particularly useful in cases where it is desired to use the support frame in a steeply sloped mold, or a vertical mold such as a wall.

In the illustrated embodiment, individual saddles 6 are arranged at spaced intervals along the beam member 4. This arrangement is particularly suitable for support frames 2 in which the spacing between saddles 6 is comparatively large. In an alternative embodiment, multiple saddles 6 may be provided by continuously formed prongs 8 defining a saw-tooth shaped wall along the beam member 4, as may be seen in FIG. 2.

Figure 3A:
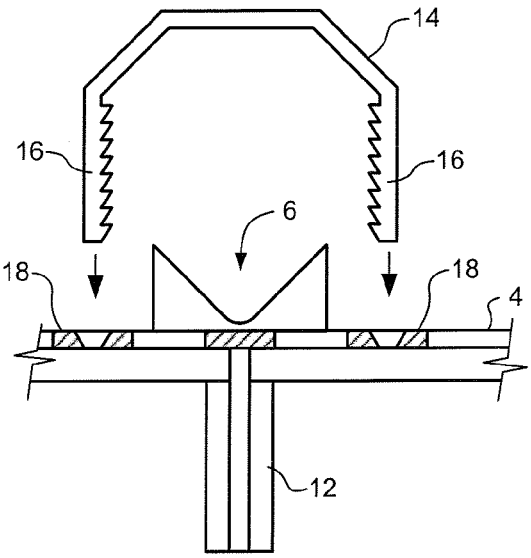
FIGS. 3*a*-3*c* are cross section views showing operation of the saddle and clip of a support frame in accordance with the embodiment of FIG. 1.
Figure 3B:
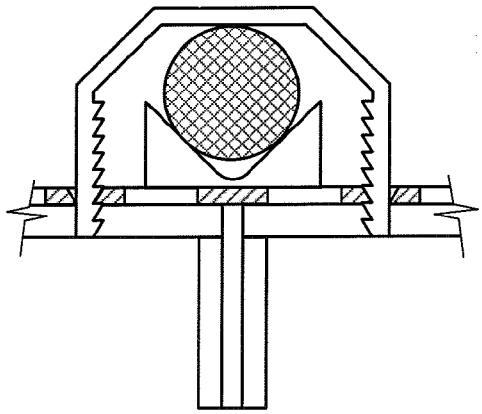
Figure 3C:
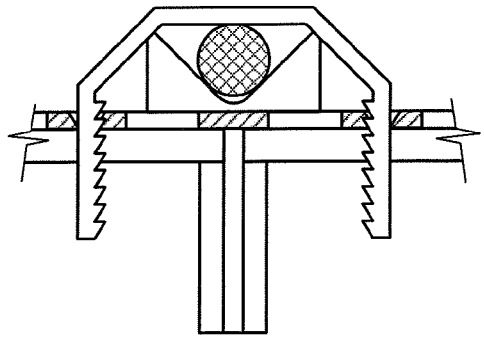

FIG. 3*a* illustrates a clip 14 of a type which may be used in conjunction with support frame 2 to secure re-bars in desired ones of the saddles 6. In the illustrated embodiment, the clip 14 is provided as a U-shaped element having a pair of barbed arms 16 which are designed to engage corresponding sockets 18 of the beam member 4. With this arrangement, the clip 14 can be easily placed over a re-bar, and pressed down (eg using thumb pressure) to lock the clip 14 into sockets 18 provided in the beam member 4, and thereby secure a re-bar onto the support frame 2. Thus re-bars can be placed quickly and accurately, and held securely during the subsequent concrete pour. As may be seen in FIGS. 3*b* and 3*c*, the V-shaped notch 10 of the saddles 6 enables accurate spacing of re-bars to be maintained even for a wade range of different sizes of re-bar.

Figure 4A:
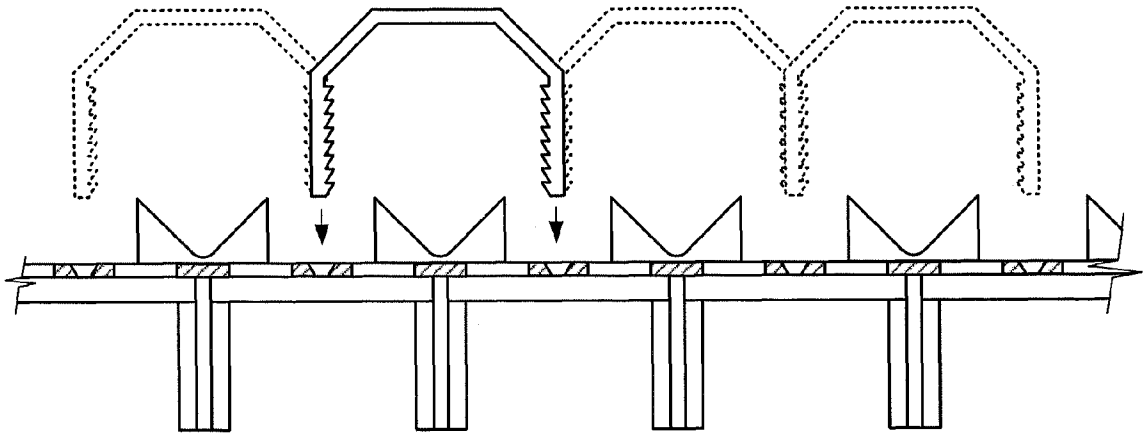
FIGS. 4*a* and 4*b* are cross section views showing respective alternative embodiments of a support frame.
Figure 4B:
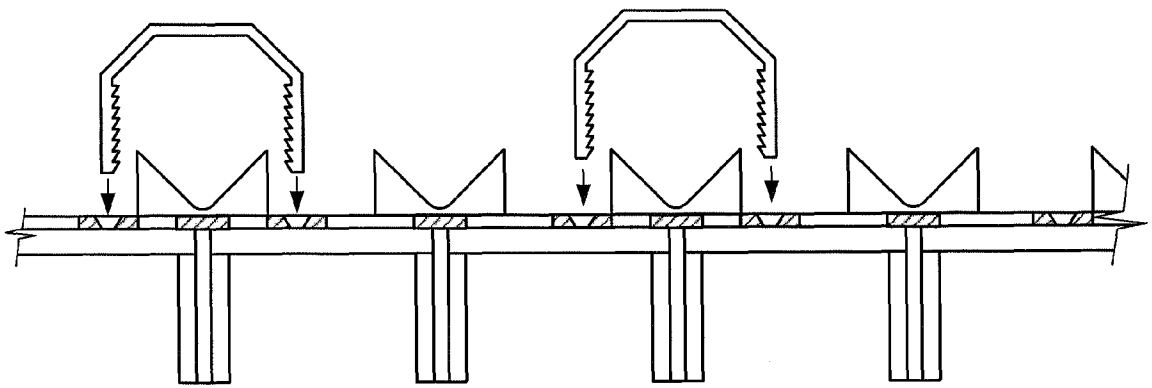

As may be appreciated, the sockets 18 can be positioned along the beam member 4 to facilitate the use of clips in various configurations. FIGS. 4*a* illustrates an example embodiment in which sockets 18 are arranged symmetrically relative to the saddles 6, such that a clip can be inserted and secured over any desired saddle 6. FIG. 4*b* illustrates an alternative example embodiment in which sockets 18 are arranged asymmetrically relative to the saddles 6, such that clips can be inserted and secured over every second saddle 6. Those of ordinary skill in the art will readily devise alternative configurations, all of which are contemplated to be encompassed with the scope of the present invention.

As may be appreciated, the support frame 2 can be constructed in any suitable length, and incorporate an appropriate number of saddles 6. Thus for example, support frames may be constructed in 4-foot lengths with 24 saddles 6 arranged on a 2-inch spacing. Other configurations of the frame member 2 may be constructed as desired. As may be appreciated, it is a simple matter to cut a support frame 2 to provide a shorter frame member 2 of a desired length. Preferably, individual support frames are designed to be connected together end-to-end to enable assembly of a support frame 2 having any desired length. Still more preferably, the connection between individual support frames is constructed such that the saddle (and thus, the re-bar) spacing is maintained constant along the entire length of the assembled support frame 2.

Figure 5A:
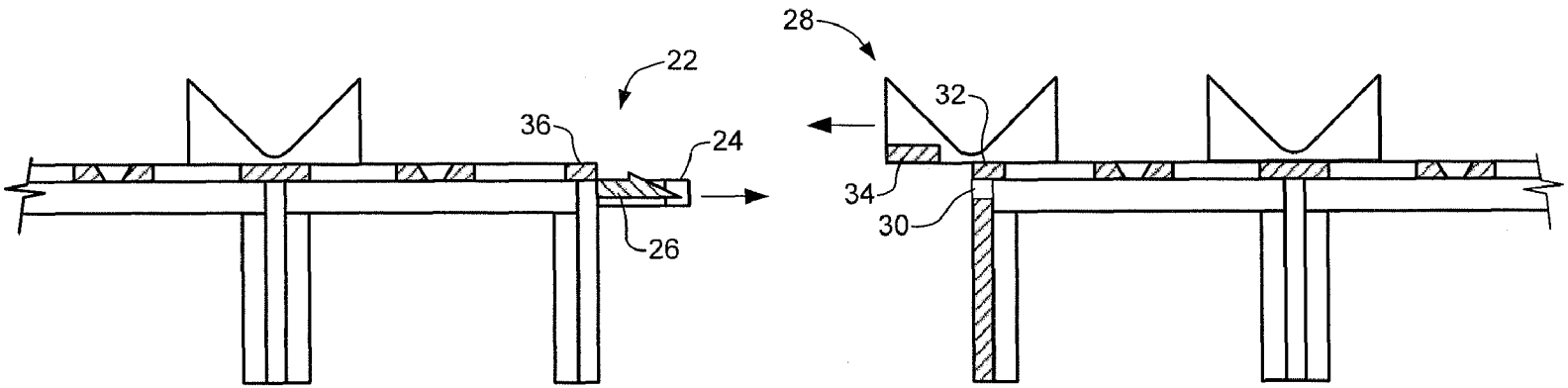
FIGS. 5*a* and 5*b* are cross section views showing operation of the bayonet and clip for connecting support frames in accordance with the embodiment of FIG. 1
Figure 5B:
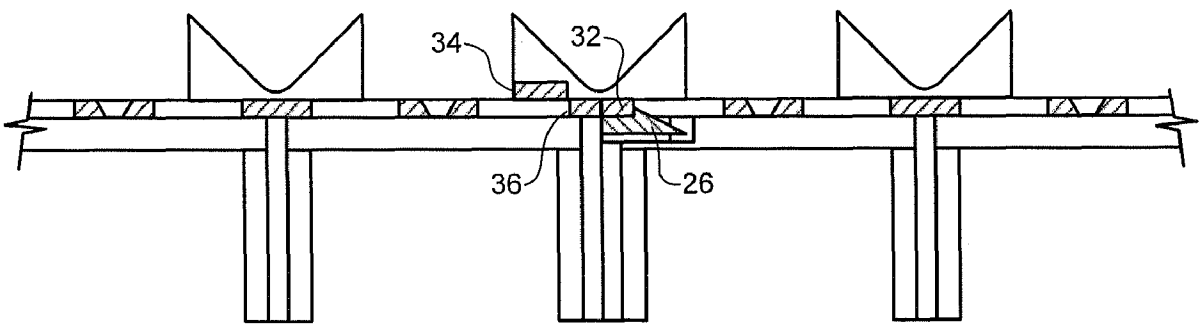

Referring to FIGS. 1 and 5, in the illustrated embodiment, this is accomplished by configuring the beam member 4 with a male end 22 comprising alignment prongs and a locking barb 26, and a female end 28 comprising alignment holes 30 (FIG. 5). With this arrangement, the locking barb 26 passes through one of the alignment holes 30 and engages a cross-member 32 of the mating support frame, so as to lock the two support frames together. By this means, two or more beam members to be locked together end-to-end, as may be seen in FIG. 5*b*. The location of saddles on the elongated beam member is arranged such that the constant spacing between saddles (and thus re-bars) is maintained and continued along the joined-together beam members.

It will be appreciated that there are many different configurations in which the saddles are arranged along the beam member 4 which can achieve the desired constant spacing between saddles (and thus re-bars) is maintained along joined-together beam members. In the illustrated embodiments, the saddle 6 positioned at the female end 28 of the beam member 4 is arranged to overhang the end of the beam member 4. When two support frames are joined together in the manner described above, this overhanging saddle lies on (and thus is supported by) the male end 22 of the mating support frame. A cross-arm 34 spanning between the overhanging prongs 8 of this saddle 6 protects the prongs from damage during storage and handling of the support frames, and provides an enlarged bearing surface between the overhanging prongs and the male end 22 of the mating support frame. If desired, this cross-arm 34 may include a barb (not shown) designed to engage a corresponding cross-arm 36 of the male end 22 of the mating support frame so as to provide (in conjunction with be barb 26) a double-locking mechanism between the joined support frames.

The embodiments of the invention described above are intended to be illustrative only. The scope of the invention is therefore intended to be limited solely by the scope of the appended claims.

I claim:

1. A support frame system for placing and securing reinforcing bars, comprising:

a beam member including an elongated upper surface;

a plurality of saddles disposed at a predetermined fixed spacing along opposite edges of the elongated upper surface, each saddle defining a V-shaped notch for receiving a reinforcing bar;

a plurality of sockets disposed at a predetermined fixed spacing along the elongated upper surface proximal at least a portion of the saddles;

means for locking the beam member to the respective beam member of a second support frame, wherein the predetermined spacing between saddles is preserved along the joined-together support frames; and a clip designed to engage a respective pair of the sockets for securing a reinforcing bar in a respective one of the saddles.

2. The system as claimed in claim 1, wherein the clip comprises a U-shaped member having a pair of barbed arms, each arm configured to engage a respective socket of the beam member.

3. The system as claimed in claim 1, wherein the plurality of saddles are integrally formed with the beam member.

4. The system as claimed in claim 1, wherein at least one saddle overhangs an end of the elongated upper surface, the overhanging saddle being adapted to bear on the upper surface of the second support frame.

5. The system as claimed in claim 4, wherein further comprising a cross-arm spanning between an overhanging portion of the overhanging saddle.

6. The system as claimed in claim 1, wherein individual saddles are arranged at spaced intervals along the elongated upper surface.

7. The system as claimed in claim 1, wherein the plurality of saddles along opposite edges of the elongated upper surface are defined by respective saw-tooth shaped walls.

8. The system as claimed in claim 1, wherein the means for locking the beam member to the respective beam member of a second support frame comprises:

at least one alignment prong disposed on a first end of the beam member;

a locking barb disposed on the first end of the beam member proximal the at least one alignment prong; and alignment holes disposed on a second end of the beam member for receiving respective alignment prongs and locking barb of the second support frame.

9. The system as claimed in claim 1, further comprising a plurality of legs for supporting the beam member at a predetermined distance from a support surface.

10. The system as claimed in claim 9, wherein a spacing between the plurality of legs corresponds with the spacing between saddles.

11. The system as claimed in claim 9, wherein each leg includes a tab enabling the support frame to be secured to a support surface.

* * * * *